US011024269B2

(12) United States Patent
Reddick

(10) Patent No.: US 11,024,269 B2
(45) Date of Patent: Jun. 1, 2021

(54) MODULAR ELECTRIC GUITAR SYSTEM

(71) Applicant: Ian Reddick, Savannah, GA (US)

(72) Inventor: Ian Reddick, Savannah, GA (US)

( * ) Notice: Subject to any disclaimer, the term of this patent is extended or adjusted under 35 U.S.C. 154(b) by 0 days.

(21) Appl. No.: 15/931,904

(22) Filed: May 14, 2020

(65) Prior Publication Data

US 2020/0365119 A1 Nov. 19, 2020

Related U.S. Application Data

(60) Provisional application No. 62/848,883, filed on May 16, 2019.

(51) Int. Cl.
*G10D 1/08* (2006.01)
*G10H 3/18* (2006.01)

(52) U.S. Cl.
CPC ..... *G10D 1/085* (2013.01); *G10H 3/181* (2013.01); *G10H 3/183* (2013.01)

(58) Field of Classification Search
CPC ..... G10H 3/186; G10H 1/32; G10H 1/46; G10H 3/181; G10H 1/00; G10D 1/085; G10D 1/00; G10D 1/08
See application file for complete search history.

(56) References Cited

U.S. PATENT DOCUMENTS 4,425,831 A 1/1984 Lipman
4,433,603 A 2/1984 Siminoff
5,252,777 A * 10/1993 Allen ..... G10H 3/182 84/726
5,347,904 A 9/1994 Lawrence
5,383,385 A 1/1995 Gilbert
5,637,823 A * 6/1997 Dodge ..... G10H 1/32 84/726
5,767,432 A * 6/1998 Randolph ..... G10D 1/085 84/267
5,929,362 A 7/1999 Oteyza
5,945,614 A 8/1999 White
5,994,633 A 11/1999 Norton
(Continued)

OTHER PUBLICATIONS

Download EGO Builder modular electric guitar from Marconi Lab—https://www.marconilab.com/prestashop/en/7288-ego-builder.

*Primary Examiner* — Marlon T Fletcher
(74) *Attorney, Agent, or Firm* — Law Offices of John G. Posa

(57) ABSTRACT

A reconfigurable electronic musical instrument includes physically separate removable and replaceable pickup and control modules facilitating rapid changes to instrument functionality. Pickup modules may contain one or more electric pickups with different response characteristics, and different control modules may be used with the different pickup modules for a nearly unlimited range of tonal variations. Pickup modules are removably received within a back cavity of the body, and control modules are coupled to the side of the body forming a portion of the instrument's peripheral profile, with front and back surfaces of the modules being flush with the front and back surfaces of the body. Self-aligning connectors on the pickup and control modules automatically establish reliable electrical signal paths upon assembly. The system may be used to configure an electric guitar, bass, 12-string, extended range, multi-scale, or any other type of fretted or fretless electric stringed instrument.

11 Claims, 6 Drawing Sheets

(56) References Cited

U.S. PATENT DOCUMENTS

| | | | | |
|---|---|---|---|---|
| 6,046,393 | A | 4/2000 | Rose | |
| 6,111,184 | A | 8/2000 | Cloud et al. | |
| 6,194,644 | B1 | 2/2001 | Hendrickson | |
| 6,253,654 | B1 | 7/2001 | Mercurio | |
| 6,274,800 | B1 | 8/2001 | Gardner | |
| 6,653,538 | B1 | 11/2003 | Wells | |
| 6,781,050 | B2 | 8/2004 | Olvera et al. | |
| 6,800,800 | B1 * | 10/2004 | Giordano | G10H 1/32 84/453 |
| 6,911,590 | B2 | 6/2005 | Childress | |
| 7,002,065 | B2 | 2/2006 | Petersen | |
| 7,256,343 | B2 | 8/2007 | Brubaker-DeMarco | |
| 7,285,709 | B2 | 10/2007 | White | |
| 7,417,185 | B2 | 8/2008 | Ludwig | |
| 7,442,865 | B2 | 10/2008 | Moghaddam | |
| 7,732,702 | B2 | 6/2010 | Ludwig | |
| 7,838,758 | B2 | 11/2010 | Ekstrom | |
| 9,245,511 | B1 * | 1/2016 | Ando | G10H 3/182 |
| 9,378,711 | B1 | 6/2016 | Stadnyk | |
| 9,454,947 | B1 | 9/2016 | Hart | |
| 9,520,109 | B1 | 12/2016 | Edwards | |
| 9,704,464 | B1 * | 7/2017 | Petschulat | G10H 3/186 |
| 9,799,316 | B1 * | 10/2017 | Owens | G10H 1/46 |
| 9,852,718 | B1 | 12/2017 | Kelly | |
| 10,540,946 | B2 | 1/2020 | Reddick | |
| 2008/0141841 | A1 * | 6/2008 | Van Ekstrom | G10H 3/186 84/291 |
| 2008/0141851 | A1 * | 6/2008 | Ekstrom | G10H 3/18 84/726 |
| 2010/0031800 | A1 * | 2/2010 | Ekstrom | G10H 3/183 84/291 |
| 2015/0356955 | A1 * | 12/2015 | Brown, Jr. | G10H 3/18 84/267 |
| 2016/0063979 | A1 * | 3/2016 | Liao | G10H 1/32 84/267 |
| 2017/0025102 | A1 * | 1/2017 | Brown, Jr. | G10H 3/18 |
| 2017/0053631 | A1 * | 2/2017 | Strassell | G10H 3/181 |

* cited by examiner

MODULAR ELECTRIC GUITAR SYSTEM

REFERENCE TO RELATED APPLICATIONS

This application claims priority to, and the benefit of, U.S. Provisional Patent Application Ser. No. 62/848,883, filed May 16, 2019, the entire content of which is incorporated herein by reference.

FIELD OF THE INVENTION

This invention relates generally to stringed instruments and, in particular, to a portable, modular platform for assembling guitars and other stringed instruments.

BACKGROUND OF THE INVENTION

Most electric stringed instruments feature a set tonal palette that is determined in large part by integrated electronics. The palette cannot be changed without the work of an experienced technician, and cannot be changed quickly.

Some guitars have been designed with interchangeable components to facilitate quick changes of the electronics, but these often come with compromises such as limited range of tonal options, controls that must be generalized to suit all potential pickup combinations, and added components that increase cost and complexity.

The need remains for electric stringed instruments that allow quick changes of the pickups and controls, thereby creating a nearly unlimited range of tonal options, while being designed with economy in mind, limiting the number of specialized components.

SUMMARY OF THE INVENTION

This invention resides in a reconfigurable electronic musical instrument with physically separate removable and replaceable pickup and control modules facilitating rapid changes to instrument functionality. Pickup modules may contain one or more electric pickups with different response characteristics, and different control modules may be used with the different pickup modules for a nearly unlimited range of tonal variations.

A reconfigurable electronic musical instrument according to the invention including a body portion with a set of strings overlying a front surface 106 of the body and a cavity accessible through the back surface of the body. Each pickup module has a front surface that includes one or more electrical pickups operative to convert string vibrations into electrical signals. Each pickup module is configured to be removably received within the cavity of the body such that each electrical pickup is proximate to the strings. The electrical signals are in electrical communication with a first electrical connector disposed on the pickup module.

Each control module, configured for removable attachment to the body, includes a second electrical connector adapted to mate with the first electrical connector, and one or more control or signal-processing devices to deliver a modified electrical signal to an output device for wired or wireless communication to an amplifier or other sound equipment. The electrical connection between the first and second electrical connectors is automatically achieved when the pickup module is received within the cavity of the body.

The control module essentially completes the instrument body by filling a void when the control module is installed. That is, the control module has a thickness corresponding to the body of the instrument at least where it interfaces to the instrument, with front and back surfaces that are flush with the front and back surfaces of the body portion as well. The control module further includes an outer side wall that completes the outer sidewall of the body, such that when the control module is installed, the control module and the rest of the body together define the overall appearance of the instrument, which may be taken to include the peripheral shape, profile or 'silhouette' of the body.

The first electrical connector may be disposed on a tab that that extends from the pickup module and overlaps with a portion of the control module containing the second electrical connector when the pickup module is received within the cavity of the body. The tab may have a back surface that is flush with the back surface of the body when the pickup module is received within the cavity of the body, such that the back surface of body overall remains smooth when both the pickup and control modules are installed.

As opposed to more rigid connections, one or both of the first and second electrical connectors exhibit a limited degree of movement prior to electrical connection, with one or more magnets or mechanically self-aligning faces being provided to automatically align the first and second electrical connectors when the pickup module is received within the cavity of the body.

The front surface of the pickup module is preferably flush with the front surface of the body when the pickup module is received within the cavity. Alternatively, the electrical pickup on the pickup module may protrude from the front surface of the pickup module and extend through a pick guard or other layer over the front surface of the body when the pickup module is received within the cavity.

The control module may include volume or other user controls accessible on the front surface thereof. The pickup module may include a plurality of electrical pickups, in which case the control module may include a pickup selection control or separate volume or tone controls accessible on the front surface of the control module.

DETAILED DESCRIPTION OF THE PREFERRED EMBODIMENTS

Figure 1:
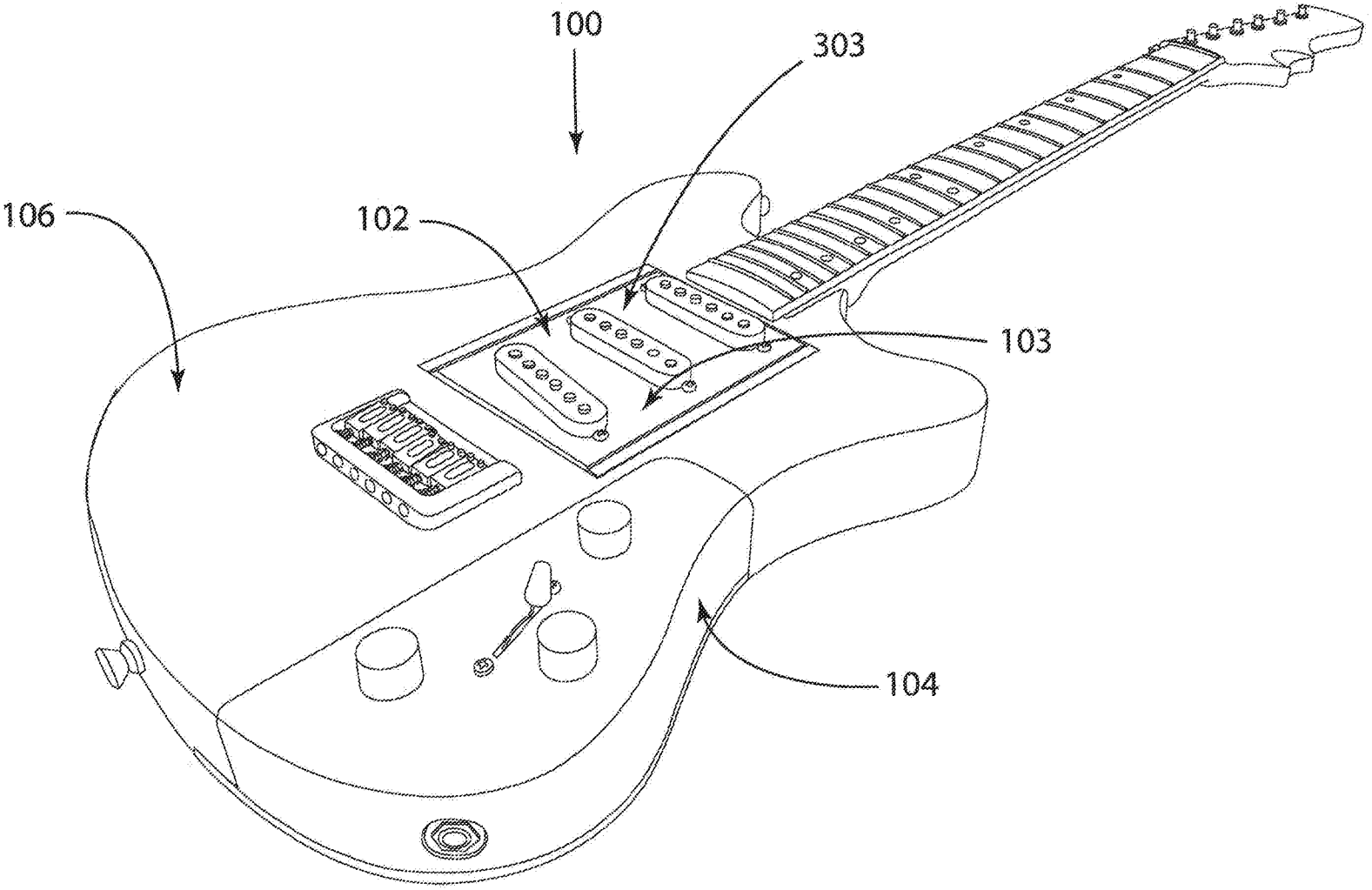
FIG. 1 is a perspective view of a modular electric guitar system constructed in accordance with the invention in assembled form.

Now making reference to the accompanying drawings, FIG. 1 depicts an instrument 100 according to the invention having interchangeable electronic pickup and control modules 102, and 104, respectively. In this embodiment, the modules 102, 104 are removably mounted on an electric stringed instrument framework. Other embodiments may assume other types of musical instruments, including a bass, 12-string, extended range, multiscale, or any other type of fretted or fretless electric stringed instrument.

Figure 2:
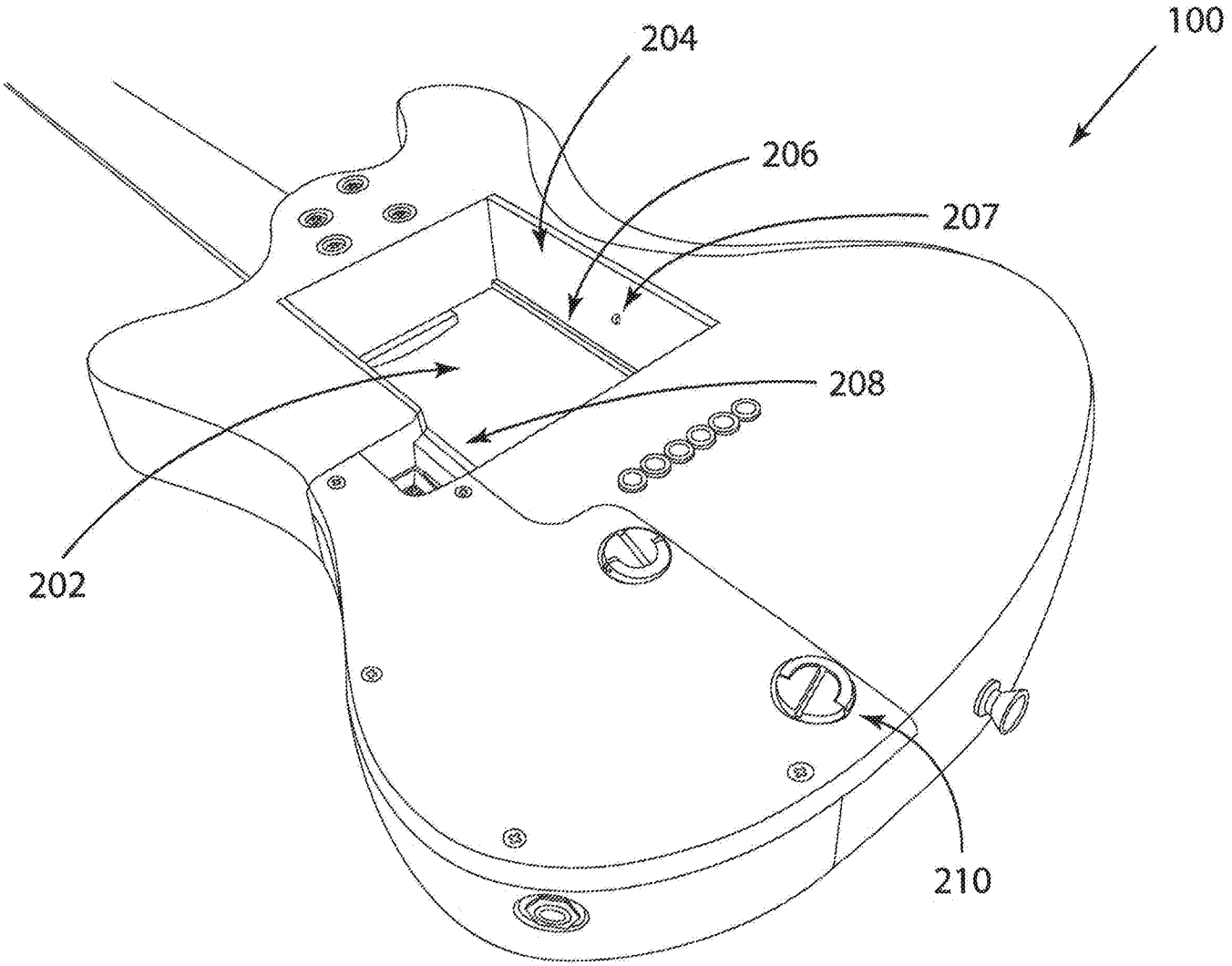
FIG. 2 is a back view of the embodiment of FIG. 1, showing a cavity into which interchangeable pickups are removably mounted.
Figure 3:
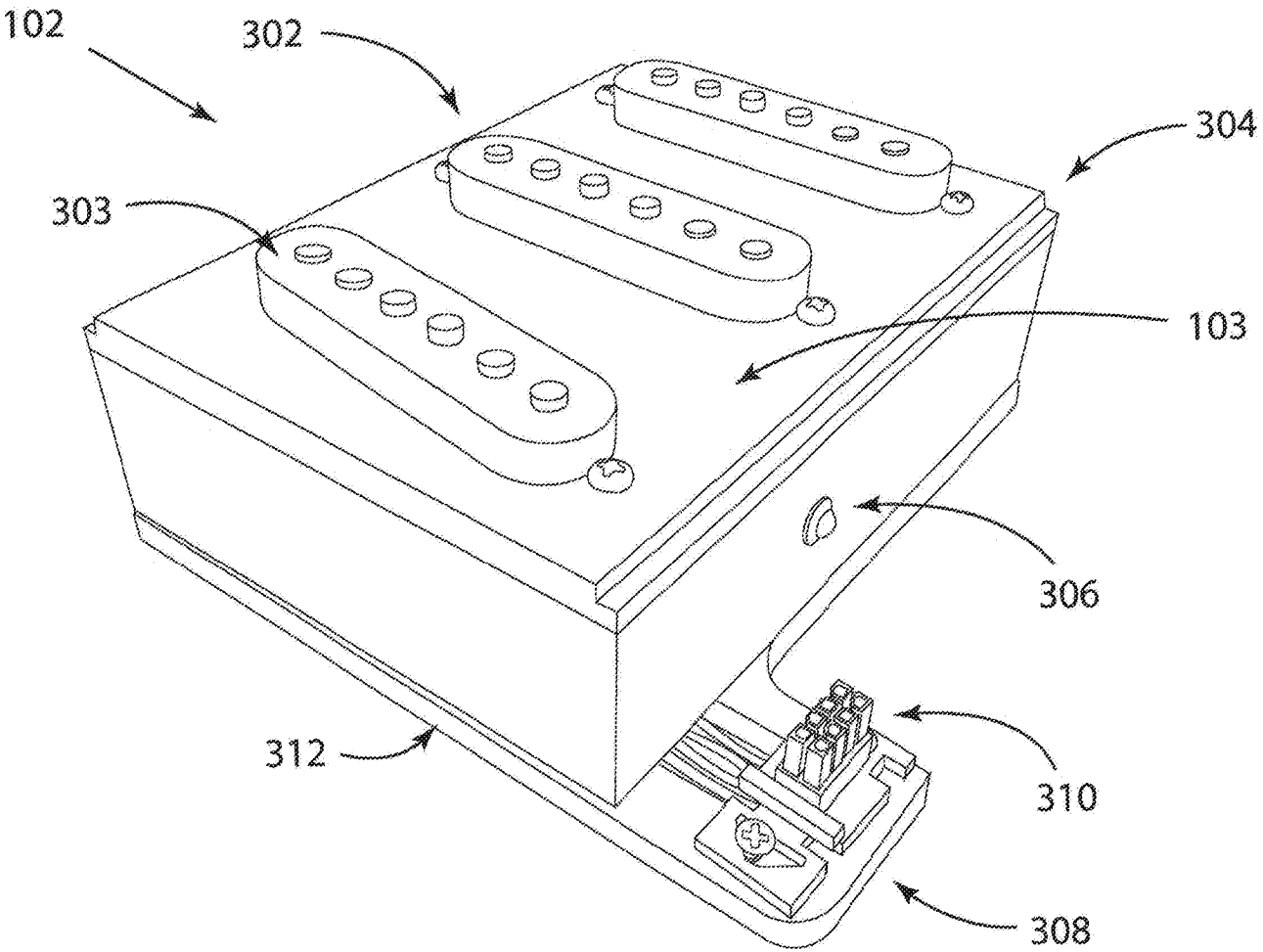
FIG. 3 is a perspective view of one possible interchangeable pickup module.
Figure 4:
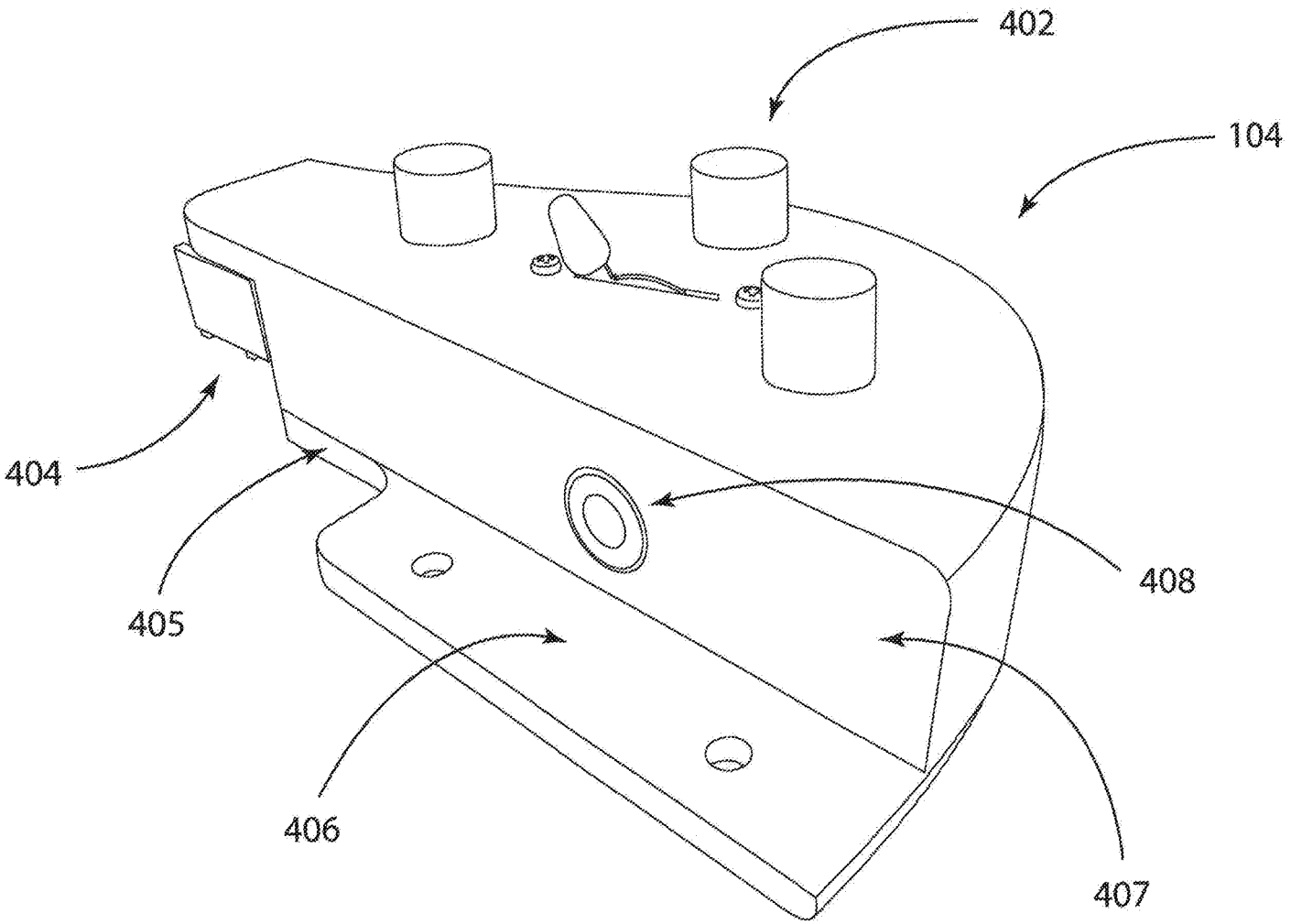
FIG. 4 is a perspective view of one possible interchangeable control module.
Figure 5:
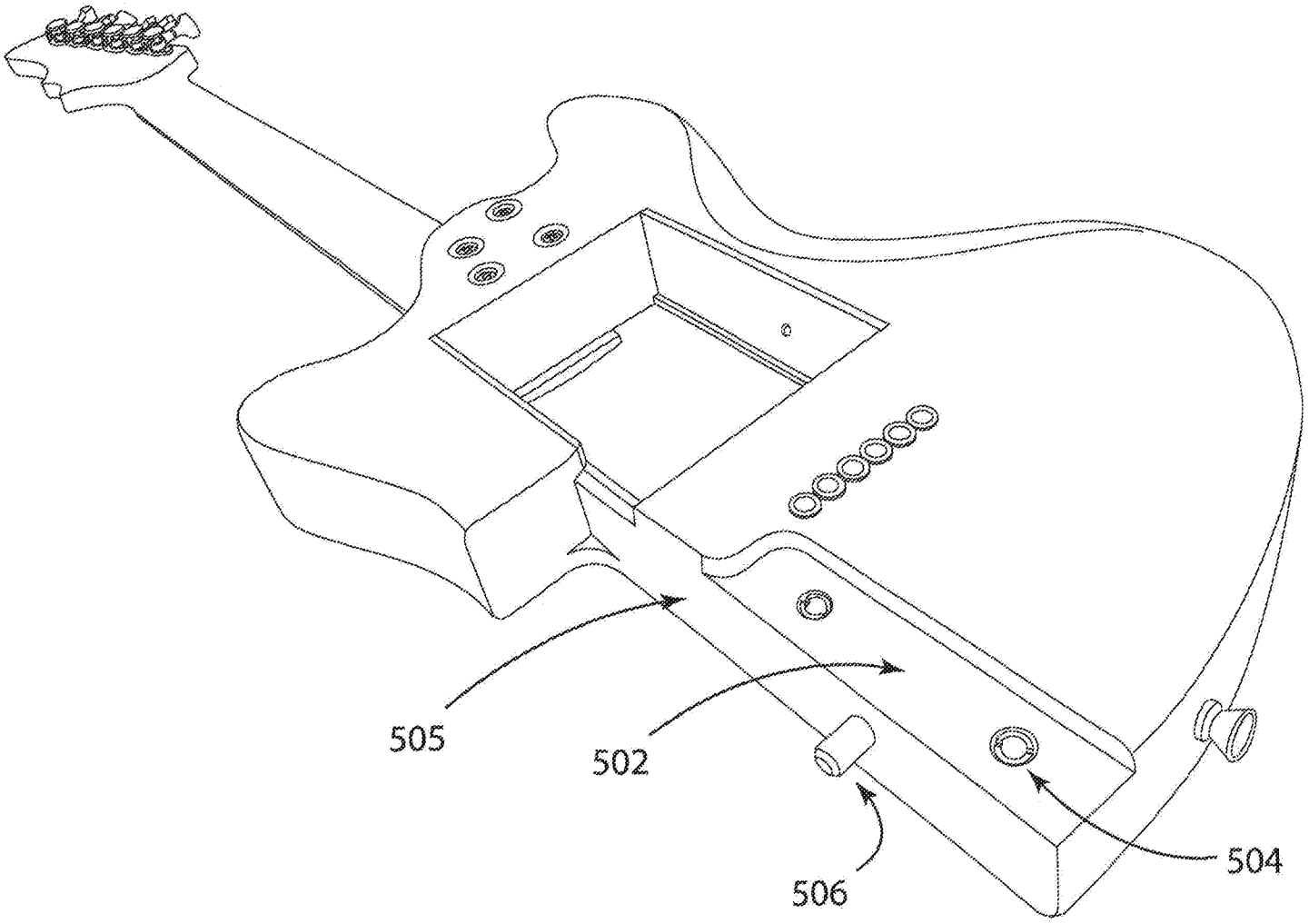
FIG. 5 is a back, side view of an instrument showing a body cut-out configured to receive interchangeable control modules such as the module of FIG. 4.

The pickup module 104 is preferably a rectangular enclosure made of wood, plastic, composite, metal, or any suitable rigid material. Its front face 103 is adapted for mounting a plurality of electrical pickups 303 which detect the vibration of the strings (not shown). The instrument 100 features an open cavity 202 (FIG. 2) into which an electronic pickup module (FIG. 3) is inserted. The pickup module 102 is preferably inserted from the back of the instrument so as not to disturb the strings.

The cavity 202 may include aluminum plates 204 mounted to the sides of the cavity, each having a small lip 206 that extends out at right angles to prevent the pickup module from escaping through the front of the cavity. In the preferred embodiment, the front face 102 of the pickup module features a pair of opposing stepped grooves 304 along the length of the left and right corners, which cooperate with the lips 206 on the aluminum plates, allowing the front face 102 of the module to be flush with the front surface 106 of the instrument. The side plates 204 protect the wood or other material of the guitar's body from repeated module insertion cycles.

The side plates 204 include detents 207 configured to receive spring-loaded ball plungers 306 on the sides of the pick-up module 302. The ball plungers 306 on the left and right sides of the module lock the module in place without the need for tools. Other mechanisms, such as springs, magnets, t-slots, rails, or thumbscrews could alternatively be used to secure the pickup module to the body. A soft material such as felt may be applied to the surface of the plate to prevent marring the surface of the pickup module.

The back plate 312 of the pickup module 102 is preferably removable to access wiring within the module. Plate 312 may feature a finger hole (not shown) or a flush mounted pull to facilitate removal. The pickup module 102 also features a tab 308 that projects out from the side of the module providing an electrical connector 310. A corresponding notch 208 in the sidewall of the cavity 202 allows the connector 310 to communicate with a mating connector 404 the control module 104. When the pickup module is installed, tab 308 overlaps with the space occupied by the control module 104 so that the electrical interface can plug directly into the control module without running this wiring through the body of the instrument. The physical arrangement also allows the electrical interconnects to pass from one module to the other without protruding from the back of the instrument.

The control module 104 comprises a removable section of the instrument's lower body portion. The control module 104 may be attached using various mechanisms such as posts, threads, latches, magnets, rails, t-slots, etc. The module 104 is hollow, and may contain various electronic control and/or signal processing devices such as potentiometers with knobs 402, switches, filters, preamps, output jacks, wireless transmitters, sound effects, etc. As discussed, downward-facing electrical interface 404 accepts the interface from the pickup module 102. As discussed in the Summary of the Invention, and as evident in FIG. 1, the control module forms a portion of the body when installed. The front, back and side surfaces of the control module are flush with the corresponding surfaces of the body, completing the overall appearance of the instrument, including the peripheral shape or 'silhouette' of the body.

Figure 6:
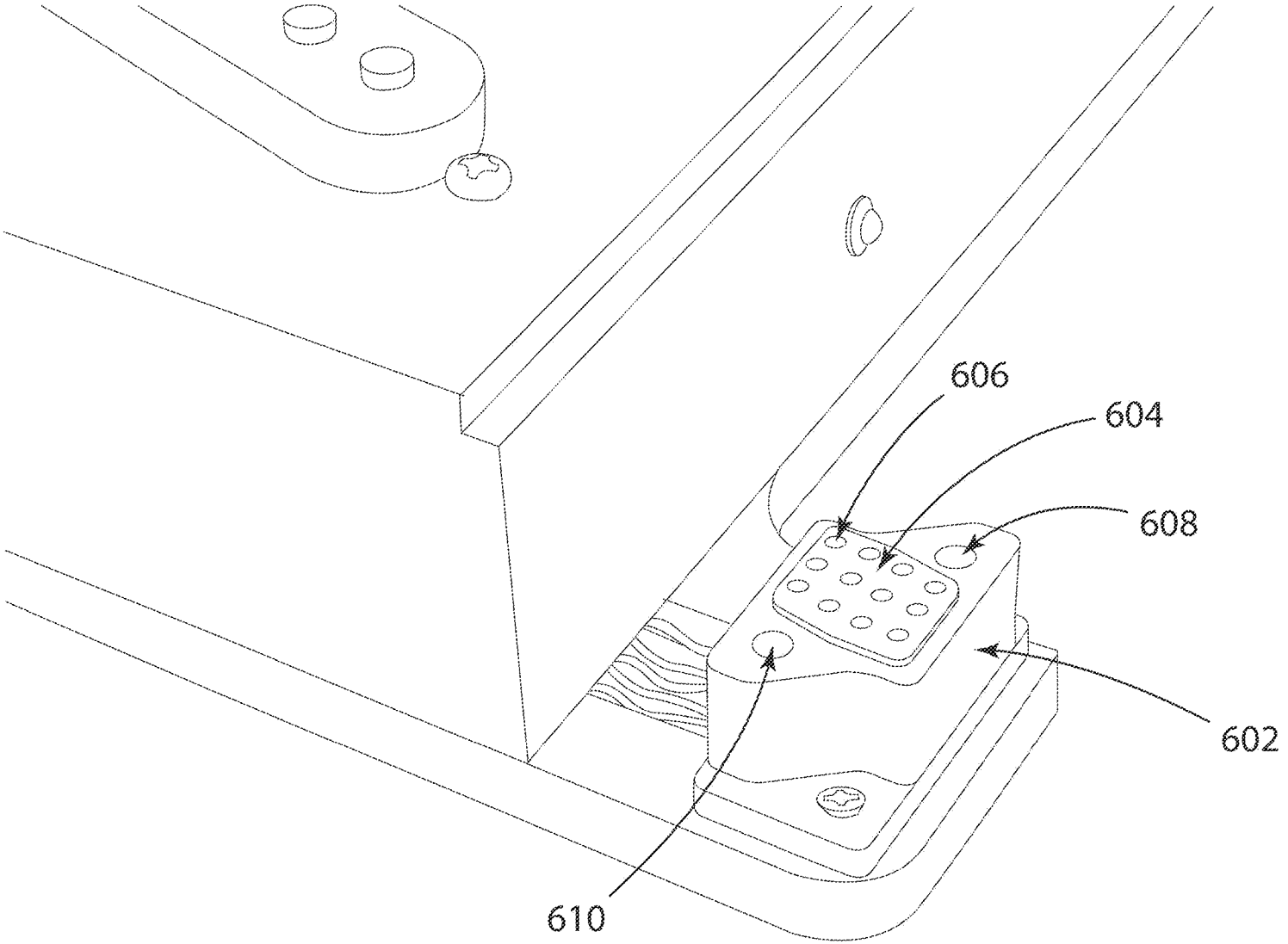
FIG. 6 is a drawing that shows a magnetically self-aligned connector.

It is important that the electrical interface must be self-aligning and create a secure connection such that jostling and vibration will not compromise electrical contact during a performance, for example. While mechanically self-aligned connectors are used in preferred embodiments, magnetic self-alignment may also be used. FIG. 6 shows a connector on the pickup module that includes a body 602 with a pad 604 having a plurality of contacts 606. Around the pad 604 there may be disposed one or more magnetic components 608, 610. The mating connector on the control module would include a corresponding set of contacts and magnetic components. Such magnetic components may comprise a permanent magnet on one side and magnetic (i.e., ferrous) material on the other, or magnets (with opposite poles) on both sides. The blocks and/or pads providing the contacts may exhibit limited lateral or axial movement prior to connection, such that in close proximity the connector on one or both side may move slightly to engage.

As with the pickup module 102, the back panel 405 (and sidewall) of the control module 104 may be removable for assembly and maintenance. The back panel 405 may include a tab 406 that extends into a mated notch 502 in the instrument's back surface, providing attachment points for the control module. Any type of tool less fastener or latch may be used, including the preferred use of recessed thumbscrews 210 (FIG. 2) that cooperate with matched threaded inserts 504 in the instrument's body.

A structure is preferably provided to align and reinforce the attachment of the control module 104 to the body of the instrument 100. As one option, the sidewall 407 of the control module 104 that faces the instrument may be equipped with a metal bushing 408 or surface that cooperates with a corresponding feature protruding from the instrument's body, in this case a metal peg or post 506. Conveniently, this feature also serves to pass the grounding wire from the instrument's bridge into the control module without the need for an additional wiring interface.

The invention claimed is:

1. A reconfigurable electronic musical instrument, comprising:

an instrument body having a front surface, a back surface, and an outer edge defining a silhouette;

a set of strings overlying a portion of the front surface of the body;

a cavity accessible through the back surface of the body;

at least one pickup module having a front surface, a back surface and a peripheral side wall;

wherein the front surface of the pickup module includes an electrical pickup operative to convert string vibrations into an electrical signal;

wherein the pickup module is configured to be removably received within the cavity of the body such that the electrical pickup is proximate to the strings, and wherein the strings are not disturbed when the pickup module is received within, or removed from, the cavity;

wherein the electrical signal from the electrical pickup is in electrical communication with a first electrical connector disposed on the pickup module;

a control module configured for removable attachment to the body, the control module including one or more control or signal-processing devices and a signal output device;

wherein the control module includes a second electrical connector disposed on the control module and configured to mate with the first electrical connector disposed on the pickup module, with the first and second electrical connectors being mechanically aligned such that an electrical connection is automatically established between the pickup module and the control module when the control module is attached to the body and the pickup module is received within the cavity of the body;

and wherein the control module includes an outer edge that forms a portion of the silhouette of the body when the control module is attachment thereto.

2. The reconfigurable electronic musical instrument of claim 1, wherein the control module has a thickness that corresponds to the thickness of the body at least where the control module attaches to the body.

3. The reconfigurable electronic musical instrument of claim 1, wherein the control module has front and back surfaces that are flush with the front and back surfaces of the body when the control module is attachment to the body.

4. The reconfigurable electronic musical instrument of claim 1, wherein the first electrical connector is disposed on a tab that that extends from the pickup module and overlaps with a portion of the control module containing the second electrical connector when the pickup module is received within the cavity of the body.

5. The reconfigurable electronic musical instrument of claim 4, wherein the tab has a back surface that is flush with the back surface of the body when the pickup module is received within the cavity of the body.

6. The reconfigurable electronic musical instrument of claim 1, wherein the first and second electrical connectors are mechanically self-aligned.

7. The reconfigurable electronic musical instrument of claim 1, wherein the first and second electrical connectors are magnetically self-aligned.

8. The reconfigurable electronic musical instrument of claim 1, wherein the front surface of the pickup module is flush with the front surface of the body when the pickup module is received within the cavity.

9. The reconfigurable electronic musical instrument of claim 1, wherein the control module includes a volume control accessible on the front surface thereof.

10. The reconfigurable electronic musical instrument of claim 1, wherein:

the pickup module includes a plurality of electrical pick-ups; and the control module includes a pickup selection control accessible on the front surface thereof.

11. The reconfigurable electronic musical instrument of claim 1, wherein the instrument is an electric guitar or bass.

* * * * *